United States Patent [19]

Yu et al.

[11] 4,325,765

[45] Apr. 20, 1982

[54] HIGH SPEED SPINNING OF LARGE DPF POLYESTER YARN

[75] Inventors: Jing-peir Yu; James E. Bromely, both of Pensacola, Fla.

[73] Assignee: Monsanto Company, St. Louis, Mo.

[21] Appl. No.: 161,716

[22] Filed: Jun. 20, 1980

Related U.S. Application Data

[63] Continuation of Ser. No. 868,093, Jan. 3, 1978, abandoned, which is a continuation-in-part of Ser. No. 778,913, Mar. 18, 1977, Pat. No. 4,176,150.

[51] Int. Cl.[3] ..... D04H 3/16

[52] U.S. Cl. ..... 156/167; 264/171; 264/177 F; 428/397

[58] Field of Search ..... 156/167; 264/210.8, 264/176 F, 177 F, 171; 428/397

[56] References Cited

U.S. PATENT DOCUMENTS 4,176,150 11/1979 Bromley et al. ..... 264/210.8

FOREIGN PATENT DOCUMENTS 51-99109 9/1976 Japan ..... 264/177 F

*Primary Examiner*—Jay H. Woo

*Attorney, Agent, or Firm*—Kelly O. Corley

[57] ABSTRACT

High speed spinning of high dpf non-round polyester filaments by extruding molten polymer through adjacent orifices spaced such that the extruded streams merge prior to solidification.

8 Claims, 1 Drawing Figure

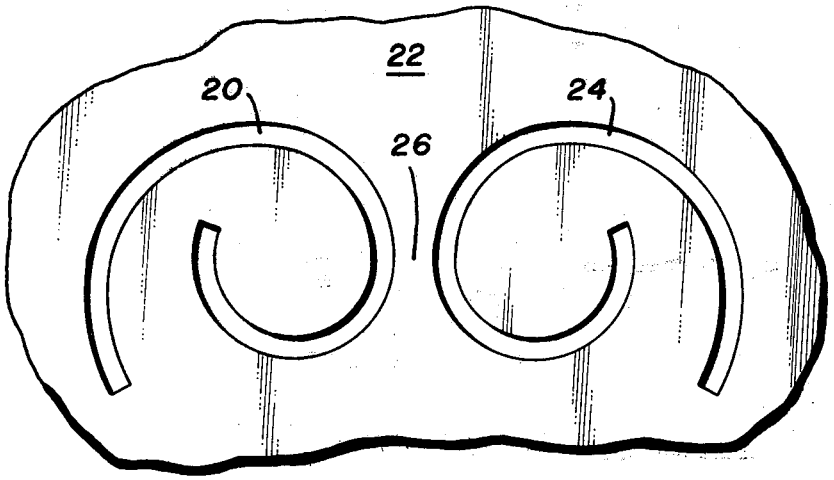
22
20
24
26

HIGH SPEED SPINNING OF LARGE DPF POLYESTER YARN

This application is a continuation of application Ser. No. 868,093, filed Jan. 3, 1978 (now abandoned), which in turn was a continuation-in-part of application Ser. No. 778,913, filed Mar. 18, 1977 (now U.S. Pat. No. 4,176,150).

This invention relates to the art of melt-spinning polyester non-round filaments at high speed.

It is generally known to extrude various molten polymers through non-round spinneret orifices and quench the resulting molten streams into non-round filaments. Ordinarily such processes proceed without particular difficulty. It has been discovered, however, that markedly non-round cross-sectional filaments having deniers of at least 10 cannot successfully be melt spun from polyester polymer at high speeds when using known techniques. According to the present invention, there is provided a novel process permitting high-speed spinning of such filaments.

According to a major aspect of the invention, the process comprises extruding a first non-round molten polyester stream through a first non-round spinneret orifice, extruding a second molten polyester stream through a second orifice, the second orifice being located sufficiently close to the first orifice that the first and second molten polyester streams unite to form a composite stream; quenching the composite stream to form a filament having a denier of at least 10; and withdrawing the filament from the composite stream at a spinning speed of at least 4000 meters per minute.

According to another aspect of the invention, the filament is withdrawn from the composite stream at a spinning speed of at least 4500 meters per minute.

According to another aspect of the invention, the second orifice is non-round

According to another aspect of the invention, the first orifice is in the form of a helix.

According to another aspect of the invention, the first orifice and second orifice are in the form of helices of opposite hand.

Other aspects of the invention will in part be disclosed below and will in part be obvious from the following detailed description taken in connection with the accompanying drawing wherein the FIGURE is a bottom plan view of a preferred combined spinneret orifice in accordance with the invention.

As shown in the FIGURE, a distinctly non-round first orifice 20 is formed in spinneret plate 22. For example, orifice 20 may be a helical slot extending through plate 22, having a width of 0.1 mm and a length along the helix of about 4.3 mm, with the helix extending over the substantially more than 360°. Most known conventional thermoplastic polymers can be melt spun successfully through orifice 20 at speeds up to at least 6500 meters per minute to yield filaments with deniers up to about 25. Polyester polymer can be similarly successfully spun to yield filaments having such large deniers at speeds below about 4000 meters per minute. At speeds above 4000 meters per minute and particularly at speeds above 4500 meters per minute, excessive breaks and generally unsatisfactory spinning performance are encountered when attempting to spin distinctly non-round polyester filaments of greater than about 10 denier. The minimum speed at which unsatisfactory spinning performance occurs varies with spinneret shape, attempted denier per filament and quenching conditions, but can readily be determined by experiment. According to the invention, larger denier polyester filaments can be successfully spun at high speeds by extruding a second molten polyester stream through a second orifice 24 located sufficiently close to orifice 20 that the two molten streams issuing from orifices 20 and 24 unite to form a composite stream, quenching the composite stream to form a filament having a denier of at least 10, and withdrawing the filament from the composite stream at a spinning speed of at least 4000 meters per minute. The second orifice may be round if desired, but preferably is also non-round. When the first orifice 20 is in the form of a helix of given hand, as is preferred, the second orifice 24 is preferably in the form of a helix of opposite hand.

EXAMPLE 1

This illustrates the problem overcome by the present invention. Polyethylene terephthalate polymer of normal molecular weight for apparel yarns is spun at a spinneret temperature of 290° C. downwardly into a 1.5 meter quenching zone supplied with transversely directed quenching air, the air having a temperature of 18° C. and a velocity of 15 meters per minute. The solidified filament is coated with a conventional spin finish and collected by a winder. The spinneret has helical orifice 20, as above disclosed, but has no closely spaced second orifice 24. The polymer metering rate and the winder speed are adjusted to attempt spinning a filament having 10 denier at 5000 meters per minute but the filament repeatedly breaks back and will not run in acceptable fashion.

EXAMPLE 2

Example 1 is repeated, except that helical orifice 24 is added, the land 26 between the nearest regions of orifices 20 and 24 being sufficiently narrow that the streams issuing from orifices 20 and 24 unite to form a composite stream. A preferred width for land 26 is about 0.9 mm. With the same polymer metering rate and winder speed, the process runs smoothly and without breaks. The polymer metering rate is increased to provide a denier of 12, and the process continues to run smoothly.

While orifices 20 and 24 have been specifically disclosed as continuous slots, either or both may be composite. That is, they may themselves be formed by a plurality of separate polymer passageways through the spinneret, the spacings or lands between the passageways which constitute a composite orifice being sufficiently narrow that the polymer streams merge to form a composite stream. For example, the passageways may be a series of closely spaced holes drilled through the spinneret blank. Such orifice constructions are disclosed in U.S. Pat. Nos. 2,804,645 to Wilfong and 2,891,277 to Sutor, the disclosures of which are incorporated herein by reference.

The term "polyester" as used herein means those polymers of fiber-forming molecular weight composed of at least 85% by weight of an ester of a dihydric alcohol and terephthalic acid. Polyesters are made commercially either by direct esterification of the acid and alcohol, or by an ester interchange reaction.

We claim:

1. A process for melt spinning a non-round polyester filament having a denier of at least 10 comprising a. extruding a first molten polyester stream through a first non-round spinneret orifice;

b. extruding a second molten polyester stream through a second orifice, said second orifice being located sufficiently close to said first orifice that said first and second molten polyester streams unite to form a composite stream;

c. quenching said composite stream to form a filament having a denier of at least 10; and d. withdrawing said filament from said composite stream at a spinning speed of at least 4000 meters per minute.

2. The process defined in claim 1, wherein said filament is withdrawn from said composite stream at a spinning speed of at least 4500 meters per minute.

3. The process defined in claim 1, wherein said second orifice is non-round.

4. The process defined in claim 1, wherein said first orifice is the form of a helix.

5. The process defined in claim 1, wherein said first orifice and said second orifice are in the form of helices of opposite hand.

6. The process defined in claim 2, wherein said first orifice and said second orifice are in the form of helices of opposite hand.

7. The process defined in claim 3, wherein said first orifice and said second orifice are in the form of helices of opposite hand.

8. The process defined in claim 4, wherein said first orifice and said second orifice are in the form of helices of opposite hand.

* * * * *

UNITED STATES PATENT AND TRADEMARK OFFICE

CERTIFICATE OF CORRECTION

PATENT NO. : 4,325,765

DATED : April 20, 1982

INVENTOR(S) : Jing-peir Yu et al

It is certified that error appears in the above-identified patent and that said Letters Patent are hereby corrected as shown below:

Title page, Inventors, "James E. Bromely" should read --James E. Bromley--.

Signed and Sealed this

*Twenth-eighth* Day of *September 1982*

[SEAL]

*Attest:*

GERALD J. MOSSINGHOFF

*Attesting Officer*

*Commissioner of Patents and Trademarks*